US005224768A

United States Patent [19]

Vautier

[11] Patent Number: 5,224,768

[45] Date of Patent: Jul. 6, 1993

[54] PORTABLE COLLAPSIBLE LECTERN

[75] Inventor: D. Robert Vautier, South Barre, Vt.

[73] Assignee: D. Roberts' Co., I.H.S., South Barre, Vt.

[21] Appl. No.: 891,434

[22] Filed: May 29, 1992

[51] Int. Cl.[5] ..... A47B 43/00

[52] U.S. Cl. ..... 312/262; 312/233; 312/258

[58] Field of Search ..... 312/262, 258, 244, 233

[56] References Cited

U.S. PATENT DOCUMENTS

| | | | |
|---|---|---|---|
| D. 306,535 | 3/1990 | Evenson . | |
| 1,670,026 | 5/1928 | De Lano | 312/258 |
| 1,817,381 | 8/1931 | Kideney | 312/258 |
| 2,808,305 | 10/1957 | Jackson | 312/258 |
| 3,034,253 | 5/1962 | Edwards | 312/258 |
| 3,562,929 | 2/1971 | Emore, Jr. | 312/262 |
| 3,644,011 | 2/1972 | MacDonald | 312/258 |
| 3,848,944 | 11/1974 | Gilmer, Jr. | 312/244 |
| 4,099,809 | 7/1978 | Leotta | 312/258 |
| 4,101,184 | 7/1978 | Barrett | 312/233 |
| 4,294,497 | 10/1981 | Daniel | 312/233 |
| 4,484,787 | 11/1984 | Stephens . | |
| 4,660,904 | 4/1987 | Stephens | 312/258 |

*Primary Examiner*—Victor N. Sakran
*Attorney, Agent, or Firm*—Salzman & Levy

[57] ABSTRACT

A portable collapsible lectern is featured that is easily transposed into an attache case. The lectern comprises an upright front panel having opposing vertical side walls perpendicularly joined thereto, and top and bottom panels horizontally disposed and perpendicularly fixed to the front panel and side walls. A pair of vertically disposed wing panels is pivotally joined along the respective vertical edge of the side walls for receiving and supporting a leaf panel therebetween. The leaf panel is pivotally joined along the horizontal edge of the top panel within the confines of the side walls, and is arranged so that it will extend from a closed position, wherein it is parallel to the front panel, to a deployed position, wherein it is outwardly extended about its pivotal axis to form a declining platform relative to the top panel. When the leaf panel is returned to its closed position, the wing panels are swung towards the center of the lectern and overlap the leaf panel in a parallel adjacent relationship thereto, thereby forming an enclosed attache case. Means are also provided for releasably securing the wing panels over the leaf panel when in its closed position.

23 Claims, 3 Drawing Sheets

PORTABLE COLLAPSIBLE LECTERN

BACKGROUND OF THE INVENTION

The present invention relates to a lectern that is collapsible and made portable in the form of a carrying case or attache case for containing and transporting papers and other materials normally carried in an attache case.

Lecterns are generally used by speakers to hold a variety of papers, documents and notes to aid the speaker in delivering a speech. Thus, the effectiveness of a speech can depend to a large extent on the materials that the speaker must use or refer to during the course of his delivery. Any material that a speaker must use or refer to, then, is generally carried or transported by means of a separate carrying case. Moreover, lecterns are not always readily available to a speaker, especially if the speaker must travel to various locations to informally deliver a speech.

Many designs have been offered in the prior art to provide for lectern portability. However, most of the designs are either too cumbersome and bulky in nature, too complicated to set up and take down, or do not possess the necessary strength or rigidity to effectively make the lectern collapsible and portable. Moreover, the designs and structures are lacking for providing a compact carrying case with sufficient space to transport materials normally contained in an attache case in an efficient manner. Such disclosures can be found, for example, in U.S. Pat. No. 4,618,120, U.S. Pat. No. 4,484,787 and Design U.S. Pat. No. 306,535.

What is needed, then, is a lectern that can accommodate both functions, that is, provide a structure or apparatus that is quick and easy to deploy and take down, and at the same time utilize the same structure or apparatus for efficiently transporting and storing the materials used by the speaker.

SUMMARY OF THE INVENTION

The present invention is intended to overcome the aforestated limitations by providing a portable, collapsible lectern that can be transformed to a carrying case, such as an attache case, for easy handling, storage and transport of any number of materials that are normally contained in an attache case. The lectern design not only allows a speaker to deliver his speech to an audience in a manner that is comfortable to him, but also eliminates the necessity of carrying another case, e.g. an attache case, for transporting his reference materials. Moreover, the efficiency of design of the lectern according to the invention herein offers a lightweight and easy to manufacture construction, and operational simplicity for setting it up and collapsing it to its original compact state.

The lectern generally comprises an upright front panel having opposing vertical side walls perpendicularly joined thereto, and top and bottom panels horizontally disposed and perpendicularly fixed to the front panel and said walls, all of the aforesaid panels and walls defining an "opened" box arrangement or compartment. In order to form a closure for the compartment, a leaf panel positioned between the side walls and pivotally joined along the horizontal edge of the top panel is provided. The leaf panel is arranged so that it will extend from a closed position, wherein the leaf panel is parallel to said front panel and enclosed within the confines of said side walls, to a deployed position wherein said leaf panel is outwardly extended about its pivotal axis to form a downwardly extending platform relative to said top panel. The outside surface of extended leaf panel forms the lectern surface upon which a speaker may rest his notes or reference materials. A lip support or pencil lip is provided along the outer bottom edge of the leaf panel to prevent such materials from falling off the leaf panel surface.

A vertically disposed wing panel is pivotally joined along the vertical edge of each side panel for receiving the extended leaf panel therebetween when the leaf panel is extended to the deployed position. Means for supporting the leaf panel in the extended position are provided, preferably in the form of a wedge support fixed to the inside surface of each wing panel, so as to allow the leaf panel to rest thereon when deployed. When the leaf panel is returned to its closed position, i.e., pivotally swung down to butt against the exposed edge of the bottom panel in a parallel relationship with the front panel, the wing panels are swung towards the center of the lectern for overlapping the leaf panel in a parallel adjacent relationship thereto. In order to allow the wing panels to close over and overlap the leaf panel, the side wall width dimension must be equal to or greater than the combined dimension of the bottom or top panel width, the leaf panel thickness, and lip support thickness. The overlapping wing panels can be secured in place, either to each other or to the bottom panel by any conventional means (such as by appropriately positioned cabinet clasps or magnets), thereby affording the speaker a secure lectern that can be easily collapsed to a compact and efficient carrying case.

The advantages of having the wing panels designed to operate in the manner described above are several. First, they provide support for the lectern when the leaf panel is extended to the deployed position; this is in addition to providing a basis for support for the inclined leaf panel itself. Second, because the leaf panel is supported between the wing panels, the wing panels act as side supports or guides for preventing any materials that are resting on the surface of the leaf panel from sliding off to the side. When the leaf panel is returned to its original closed position and the lectern collapsed, the wing panels serve to lock the leaf panel into place by overlapping the leaf panel, thereby insuring a closed and uncluttered compartment within the lectern. Moreover, by having the wing panels overlap the leaf panel, more room is left in the lectern compartment for storing or retaining materials transported with the lectern.

The present invention thus provides an efficient, easy-to-deploy and easy-to-collapse apparatus that can be used both as a portable lectern and carrying case.

BRIEF DESCRIPTION OF THE DRAWINGS

A complete understanding of the present invention may be obtained by reference to the following detailed description of a preferred embodiment taken in conjunction with the accompanying drawings, and in which.

DETAILED DESCRIPTION OF THE PREFERRED EMBODIMENT

Figure 1:
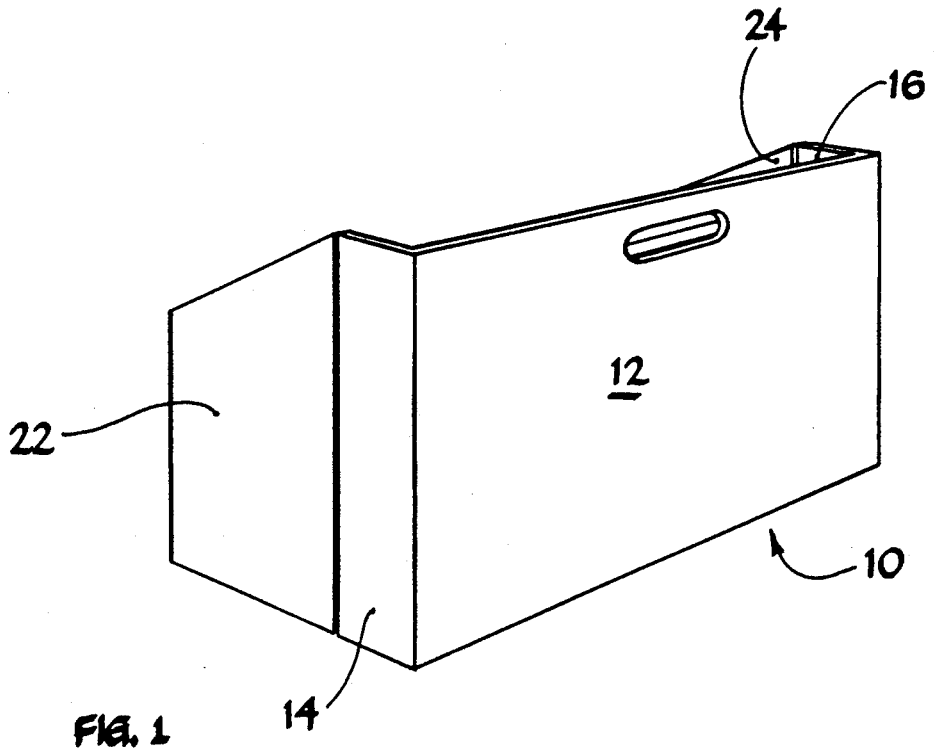
FIG. 1 is a front perspective view of an embodiment of a portable collapsible lectern in the deployed position.
Figure 2:
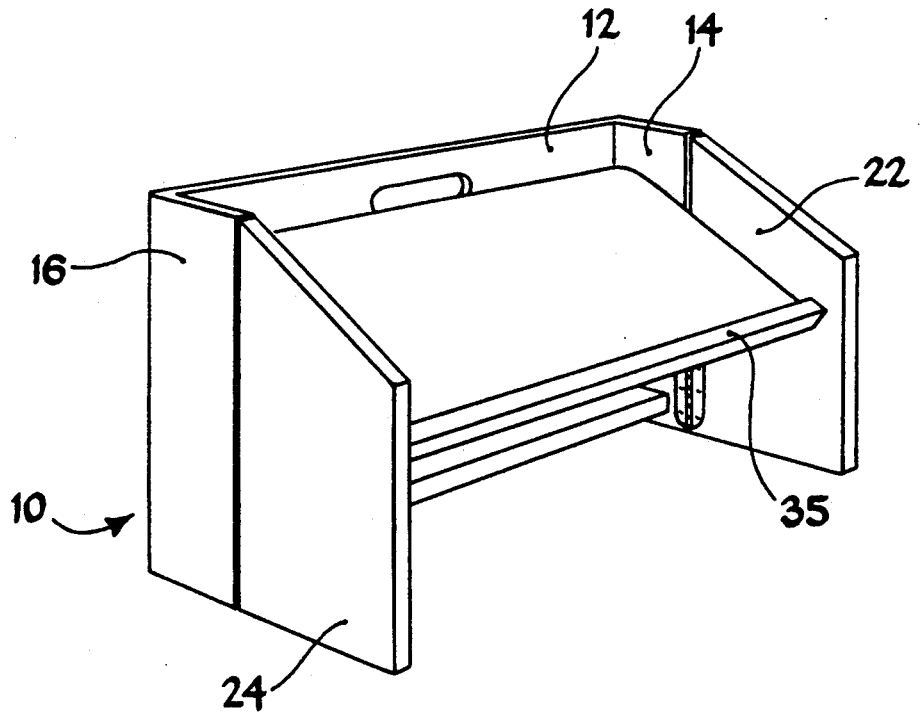
FIG. 2 is a rear perspective view of the deployed lectern shown in FIG. 1.
Figure 3:
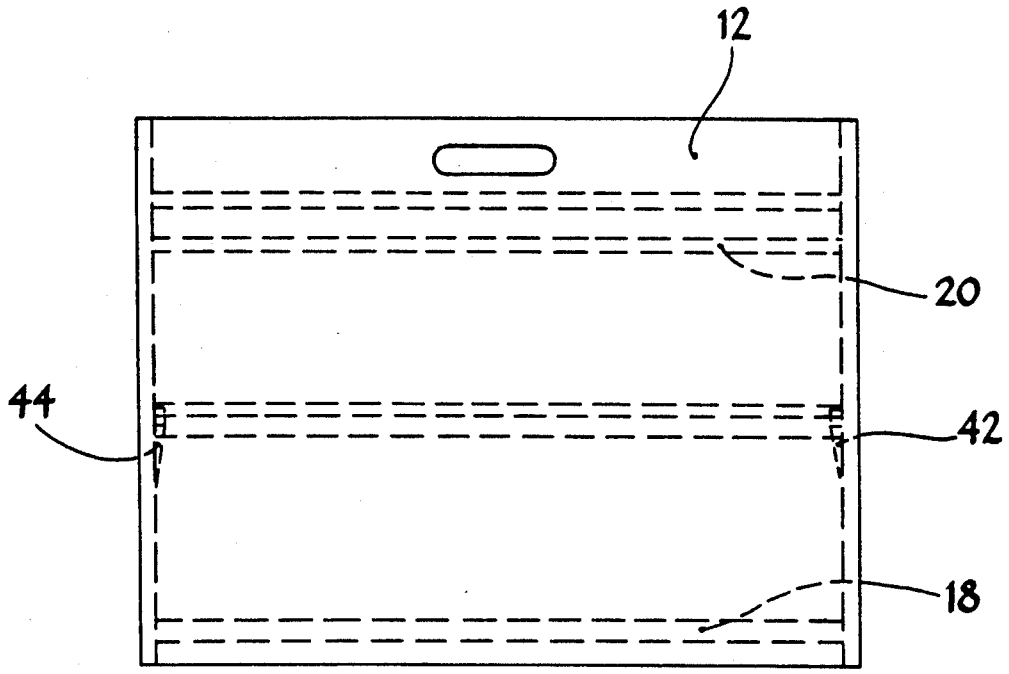
FIG. 3 is a front elevational view of the deployed lectern shown in FIG. 1.
Figure 4:
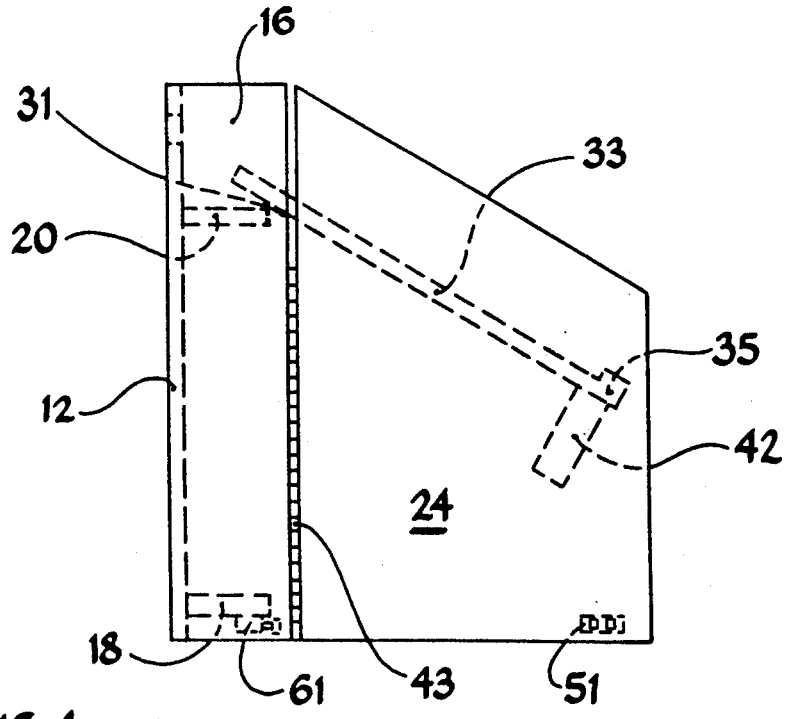
FIG. 4 is a side elevational view of the deployed lectern shown in FIG. 3

Referring to FIGS. 1 and 2, there is shown a front and rear perspective view, respectively, of a portable lectern 10 in the deployed position. The lectern is comprised of a rectangular, upright front panel 12 having a rectangular opening therein, with rounded corners, which serves as a grip for carrying and transporting the lectern 10. Vertical side walls 14 and 16 are provided and perpendicularly joined to front panel 12 at the respective ends thereof. As is shown in FIGS. 3 and 4, bottom panel 18 and top panel 20 are fixedly positioned between side walls 14 and 16 and joined to front panel 12 in a fixed horizontal relationship relative to said side walls. It is noted that any conventional handle means can be employed on or about either the front panel 12 or top panel 20, for transporting the lectern from one location to another.

As can best be seen in FIGS. 4 and 6, a rectangular leaf panel 33, designed to fit within the confines of side walls 14 and 16, is pivotally joined along the exposed edge of top panel 20 by means of a piano hinge 31 attached to said leaf panel at a transverse position below the top horizontal edge of said leaf panel. In this regard, by positioning the piano hinge on the leaf panel along a transverse point below its top edge, a greater inclined surface area of the leaf panel can be utilized by the speaker when employing the lectern.

Figure 6:
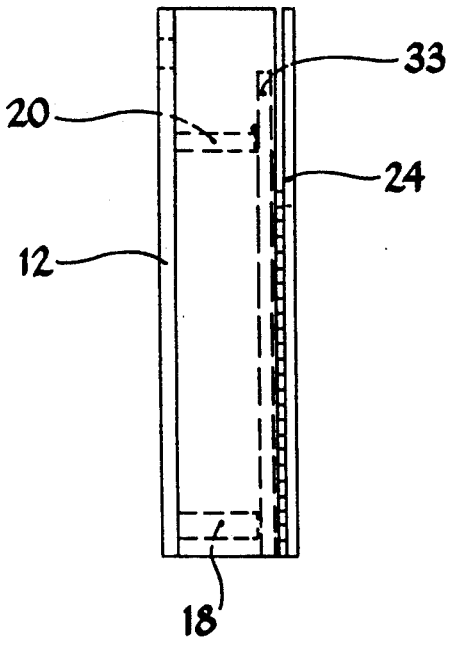
FIG. 6 is a side elevational view of the collapsed lectern shown in FIG. 5.

Leaf panel 33 is designed to pivotally move about its transverse axis along the exposed edge of top panel 20 from a "closed" position (as illustrated in FIG. 6) to an extended or "deployed" position (as illustrated in FIG. 4). When leaf panel 33 is in the "closed" position, it is in vertical parallel alignment with front panel 12 and butts against the horizontally exposed edge of bottom panel 18 to form a closed rectangular compartment defined by front panel 12, side walls 14 and 16, and top and bottom panels 20 and 18, respectively. The closed compartment simulates the interior of an attache case for storing and/or transporting materials normally carried in an attache case.

The outside bottom portion of leaf panel 33 is provided with a transverse lip support 35 to contain any papers placed on the outside surface of said leaf panel when it is raised and pivotally extended to the deployed position as shown in FIG. 4. In order to accommodate the extension and support of leaf panel 33, as well as provide vertical support to lectern 10 when in its deployed position, a wing panel 24 is provided which is pivotally joined to the vertical edge of side wall 16 via a spring loaded piano hinge 43. In like manner, wing panel 22 is provided and pivotally joined to the vertical edge of opposing side wall 14 via spring loaded piano hinge 45. Thus, when lectern 10 is deployed, leaf panel 33 will be outwardly extended about piano hinge 31, and the inside bottom portion of the leaf panel made to rest on a pair of wedge supports 42 and 44 attached respectively to the inside surface of wing panels 24 and 22.

It will be noted that in the embodiment illustrated in FIG. 2, wing panels 22 and 24 have their top portions slanted in a downward angle which approximates the same angle offered by the extension of leaf panel 33 from its pivotal axis. With this design configuration, the wing panels 22 and 24 will act a side supports and/or guides for preventing any materials that are resting on the surface of leaf panel 33 from sliding off to the side. As previously stated, lip support 35 will prevent such materials from sliding off the bottom of leaf panel 33. Thus, a speaker employing the lectern according to the embodiment shown in accompanying FIGS. 1 and 2, will have materials placed on the surface of leaf panel 33 comfortably secured for immediate reference.

While piano hinges are employed for pivotally joining wing panels 22 and 24 and leaf panel 33 to their fixed counterparts, it will be understood that any conventional means can be utilized to accomplish the pivotal movement of the aforestated panels.

Figure 5:
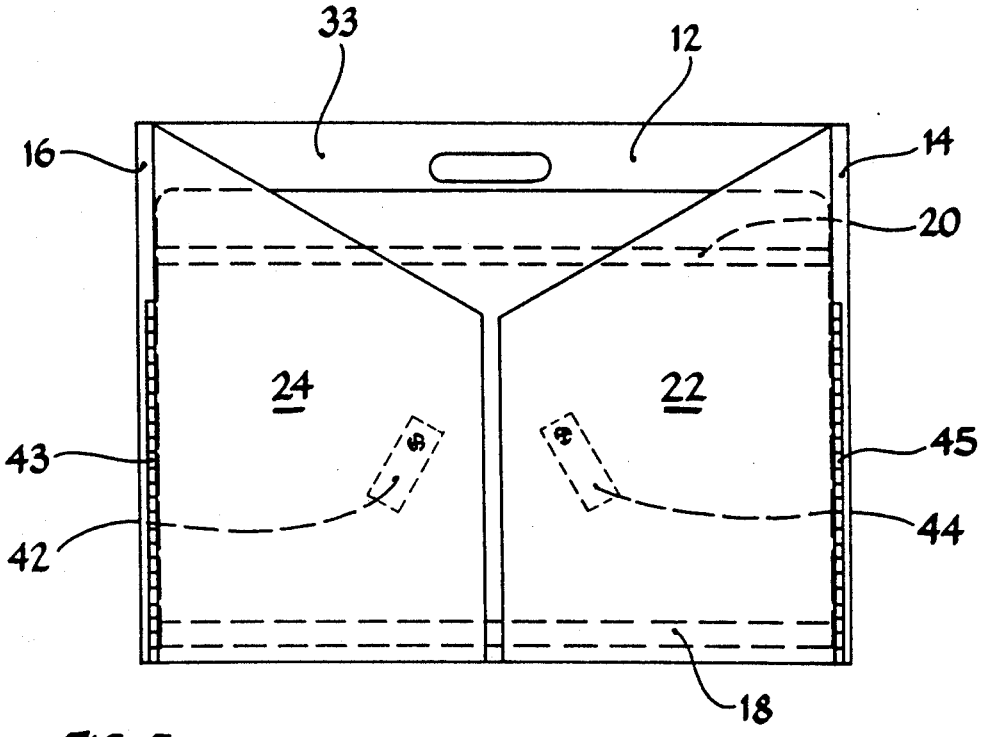
FIG. 5 is a rear elevational view of the portable lectern shown in FIG. 2 in the collapsed position.

When it is desired to collapse lectern 1 to its original state or "closed" position, wing panels 22 and 24 are spread apart away from each other which will permit wedge supports 44 and 42 to be withdrawn from the underside of leaf panel 33, thereby allowing leaf panel 33 to pivot about piano hinge 31 and fall back via gravity to its closed position. This is shown in FIG. 6. Once leaf panel 33 returns to its vertical position, i.e., parallel to front panel 12, wing panels 22 and 24 are pivotally rotated about their respective piano hinges 45 and 43 and made to overlap leaf panel 33 in an adjacent parallel relationship thereto, as is illustrated in FIG. 5. Wing panels 22 and 24 can be secured in the position shown in FIG. 5 by any conventional means, such as by magnets or by male and female cabinet clasps secured to the appropriate portions of the wing panels and bottom panel 18, thereby locking the wing panels in place as well as securing and maintaining leaf panel 33 in its closed vertical position. Thus, as shown in FIGS. 4 and 5, male cabinet clasps 50 and 51 are fixedly secured to the bottom end portions of wing panels 22 and 24, respectively, for mating with appropriately placed female cabinet clasps 60 and 61, respectively, secured to bottom panel 18.

In connection with the overlapping of wing panels 22 and 24 over leaf panel 33, it is important to note that the width dimension of side panels 14 and 16 must be equal to or greater than the combined dimension of the width of bottom panel 18 or top panel 20, the thickness of leaf panel 33, and thickness of lip support 35. Otherwise, leaf panels 22 and 24 will not be able to overlap leaf panel 33 to provide a fully collapsible and compact lectern.

The portable lectern according to the invention herein may be fabricated from any readily available rigid material, such as wood, plexiglas, plastic, metal, or from mold injection techniques that are known to a person skilled in the art. Wood and plastic are the preferred materials. Moreover, various ornamental embellishments in the form of trim, brass corners and advertising displays on the outer surface of front panel 12 can be incorporated into the overall design of the lectern herein.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

What is claimed is:

1. A portable collapsible lectern comprising a) an upright front panel having opposing vertical side walls perpendicularly fixed thereto;

b) a top and bottom panel horizontally disposed between said side walls and perpendicularly fixed to said front panel and said side walls, said top and bottom panels being spaced apart in parallel relationship relative to each other;

c) a leaf panel positioned between said side walls and pivotally joined along the horizontal edge of said top panel for extending from a closed position, wherein a closed compartment is defined when said leaf panel is parallel to said front panel, to a deployed position wherein said leaf panel is outwardly extended about its pivotal axis to form an inclined platform;

d) a pair of vertically disposed wing panels pivotally joined along the respective vertical edges of said side walls, for receiving said extended leaf panel therebetween when said leaf panel is in a deployed position, and for overlapping said leaf panel in a parallel adjacent relationship thereto when said leaf panel is in the closed position; and e) means for supporting said leaf panel between said wing panels when said leaf panel is in the deployed position.

2. The apparatus defined in claim 1 additionally comprising handle means within the top portion of said front panel for transporting said lectern.

3. The apparatus defined in claim 1 additionally comprising handle means disposed about the top of said top panel for transporting said lectern.

4. The apparatus defined in claim 1 additionally comprising a lip support transversely disposed along the outside bottom portion of said leaf panel.

5. The apparatus defined in claim 1 additionally comprising means for releasably securing the overlapping of said wing panels in place when said leaf panel is in the closed position.

6. The apparatus defined in claim 5 wherein said means for releasably securing said wing panels in place comprises cabinet clasps fixed to the bottom portion of said wing panels and said bottom panel.

7. The apparatus defined in claim 1 wherein said means for supporting said leaf panel between said wing panels comprises a wedge support fixed to the inside portion of each wing panel to permit support of said leaf panel in a downwardly extending angle relative to said top panel.

8. The apparatus defined in claim 1 wherein the top portion of said wing panels slant at a downward angle approximating the same angle as that formed by the extension of said leaf panel relative to said top panel in the deployed position.

9. The apparatus defined in claim 1 wherein said wing panels are pivotally mounted to their respective side walls by means of a hinge having a spring bias.

10. The apparatus defined in claim 1 wherein said side walls and panels are fabricated from a rigid material.

11. The apparatus defined in claim 10 wherein said side walls and panels are fabricated from wood.

12. The apparatus defined in claim 10 wherein said side walls and panels are fabricated from a rigid plastic material.

13. A portable collapsible lectern comprising a) an upright front panel having opposing vertical side walls perpendicularly fixed thereto;

b) a top and bottom panel horizontally disposed between said side walls and perpendicularly fixed to said front panel and said side walls, said top and bottom panels being spaced apart in parallel relationship relative to each other;

c) a leaf panel positioned between said side walls and pivotally joined along the horizontal edge of said top panel for extending from a closed position, wherein a closed compartment is defined when said leaf panel is parallel to said front panel, to a deployed position wherein said leaf panel is outwardly extended about its pivotal axis to form an inclined platform;

d) a pair of vertically disposed wing panels pivotally joined along the respective vertical edges of said side walls, for receiving said extended leaf panel therebetween when said leaf panel is in a deployed position, and for overlapping said leaf panel in a parallel adjacent relationship thereto when said leaf panel is in the closed position;

e) means for supporting said leaf panel between said wing panels when said leaf panel is in the deployed position; and f) means for releasably securing the overlapping of said wing panels in place when said leaf panel is in the closed position.

14. The apparatus defined in claim 13 additionally comprising handle means within the top portion of said front panel for transporting said lectern.

15. The apparatus defined in claim 13 additionally comprising handle means disposed about the top of said top panel for transporting said lectern.

16. The apparatus defined in claim 13 additionally comprising a lip support transversely disposed along the outside bottom portion of said leaf panel.

17. The apparatus defined in claim 13 wherein said means for releasably securing said wing panels in place comprises cabinet clasps fixed to the bottom portion of said wing panels and said bottom panel.

18. The apparatus defined in claim 13 wherein said means for supporting said leaf panel between said wing panels comprises a wedge support fixed to the inside portion of each wing panel to permit support of said leaf panel at a downwardly extending angle relative to said top panel.

19. The apparatus defined in claim 13 wherein the top portion of said wing panels slant at a downward angle approximating the same angle as that formed by the extension of said leaf panel relative to said top panel in the deployed position.

20. The apparatus defined in claim 13 wherein said wing panels are pivotally mounted to their respective side walls by means of a hinge having a spring bias.

21. The apparatus defined in claim 13 wherein said side walls and panels are fabricated from a rigid material.

22. The apparatus defined in claim 21 wherein said side walls and panels are fabricated from wood.

23. The apparats defined in claim 21 wherein said side walls and panels are fabricated from a rigid plastic material.

* * * * *